United States Patent [19]

Novotny

[11] 4,310,125

[45] Jan. 12, 1982

[54] HAMMER FOR HAMMER MILL

[75] Inventor: Raymond J. Novotny, Sparta, N.J.

[73] Assignee: Abex Corporation, New York, N.Y.

[21] Appl. No.: 84,956

[22] Filed: Oct. 15, 1979

[51] Int. Cl.[3] ..... B02C 13/28
[52] U.S. Cl. ..... 241/195
[58] Field of Search ..... 241/194, 195, 197

[56] References Cited

U.S. PATENT DOCUMENTS 1,997,553 4/1935 Taylor, Jr. et al. ..... 241/197
3,510,076 5/1970 Perdue ..... 241/197
4,129,262 12/1978 Lowry ..... 241/195 X

FOREIGN PATENT DOCUMENTS 654283 4/1979 U.S.S.R. ..... 241/195

*Primary Examiner*—Howard N. Goldberg
*Attorney, Agent, or Firm*—Thomas S. Baker, Jr.; David A. Greenlee

[57] ABSTRACT

A hammer adapted to be pivotally mounted between a pair of rotors in a hammer mill has a pair of sidewalls each of which is adjacent a rotor. Each sidewall has a recess which collects small pieces of scrap which get trapped between the sidewall and the adjacent rotor. A portion of the recess extends beyond the outer periphery of the adjacent rotor so that scrap collected in the recess can be ejected therefrom.

4 Claims, 5 Drawing Figures

HAMMER FOR HAMMER MILL

BACKGROUND OF THE INVENTION

1. Field of the Invention

This invention relates to an improved hammer for a hammer mill.

2. Description of the Prior Art

The subject hammers are commonly used in hammer mills which, in turn, are used to process or shred automobiles or other sheet steel scrap products. The hammer mill type shredder comprises a plurality of large discs or rotors which rotate about the axis of a main drive shaft. A plurality of hammers are pivotally attached to pairs of rotors by hinge pins along an axis parallel to the rotor drive shaft. The hammers project beyond the outer surface of the rotors and strike the material to be shredded.

It is essential to have the hammers swing freely about their hinge pins in order to shred scrap effectively. If the hammers are not able to swing freely, the rotors can be damaged and/or the hinge pins can be broken when the hammers impact the scrap material. During operation of the shredder, shredded scrap or small unshreddable pieces, such as bearings, can wedge between a hammer and an adjacent rotor and prevent the hammer from swinging about its hinge pin. Consequently, it is desirable to provide a means to prevent scrap from wedging between hammers and rotors.

SUMMARY OF THE INVENTION

The improved hammer of the instant invention prevents scrap from jamming between a hammer and a rotor by providing a way for scrap, which gets between a hammer and a rotor, to escape. Each side of the hammer adjacent a rotor has a recessed portion which provides a space for collection of small pieces of scrap which get between a hammer and a rotor. In order to eject the scrap from the recessed portion, a spill port is provided which is connected to the recessed portion and extends beyond the outer periphery of the rotor. In this way scrap pieces are ejected from the recessed portions by centrifugal force. Ejection of these pieces prevents jamming of the hammers with respect to the rotors.

DESCRIPTION OF THE PREFERRED EMBODIMENT

Figure 1:
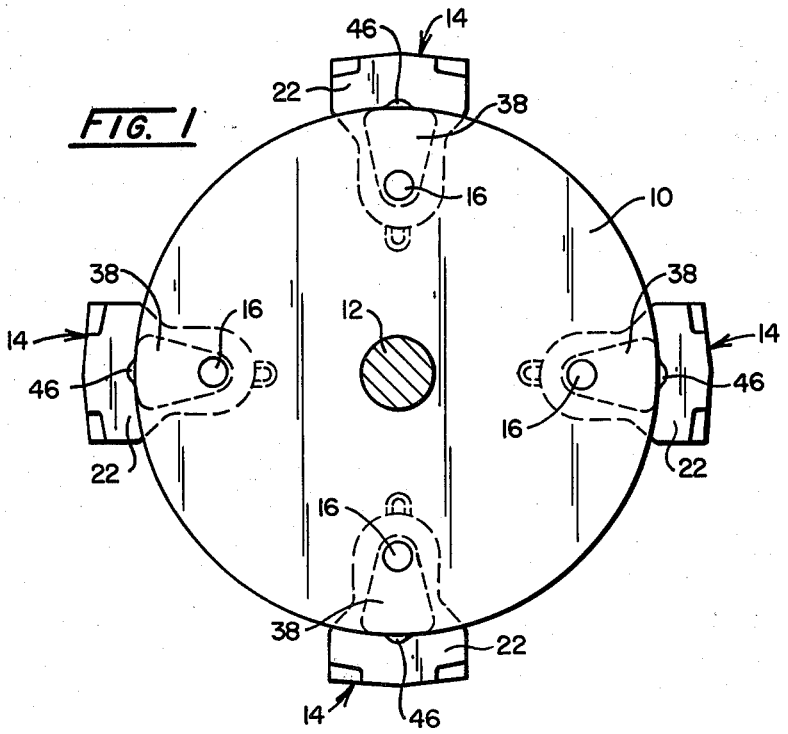
FIG. 1 is a side view of a hammer mill rotor.
Figure 2:
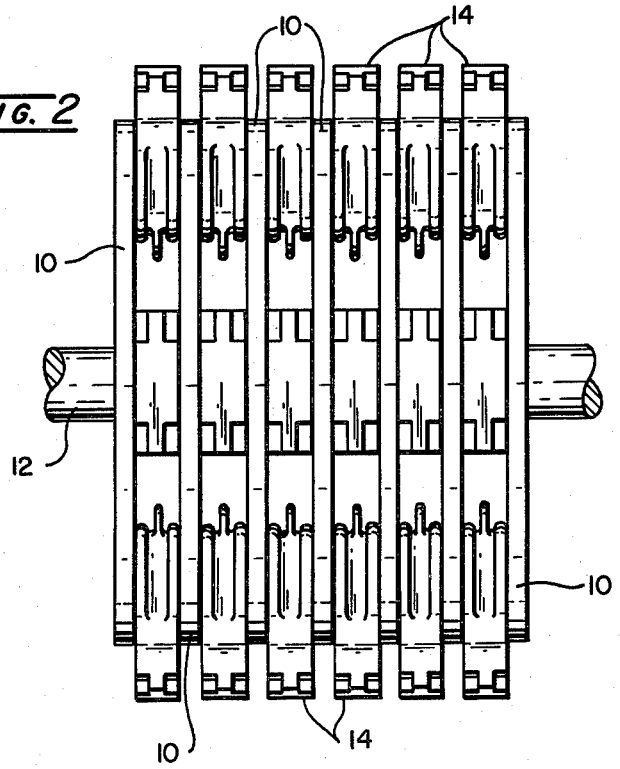
FIG. 2 is a front view of a hammer mill of FIG. 1 which shows a plurality of sets of hammers sandwiched between pairs of rotors.

FIGS. 1 and 2 show a plurality of hammer mill rotors 10, rotatably mounted on a drive shaft 12. A plurality of hammers 14 are sandwiched between adjacent pairs of rotors 10 and are pivotally attached to the rotors 10 by hinge pins 16. A set of four hammers 14 is mounted between each pair of rotors 10. Each of the four hammers 14 is positioned 90° from the one next to it. However, a set can comprise any number of hammers. It is only necessary that the hammers 14 be positioned such that the rotors 10 are balanced.

Figure 3:
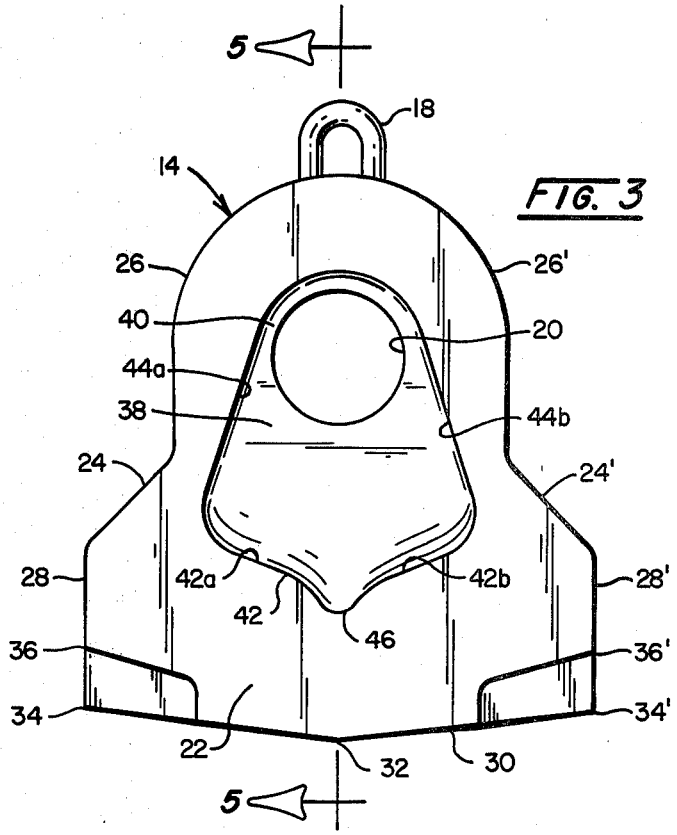
FIG. 3 is a side view of an improved hammer of the instant invention.
Figure 4:
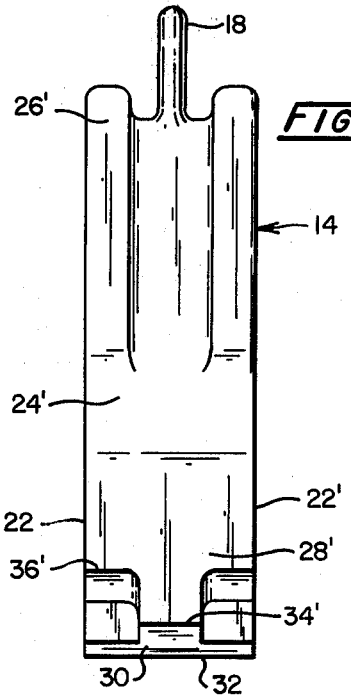
FIG. 4 is an end view of the improved hammer.
Figure 5:
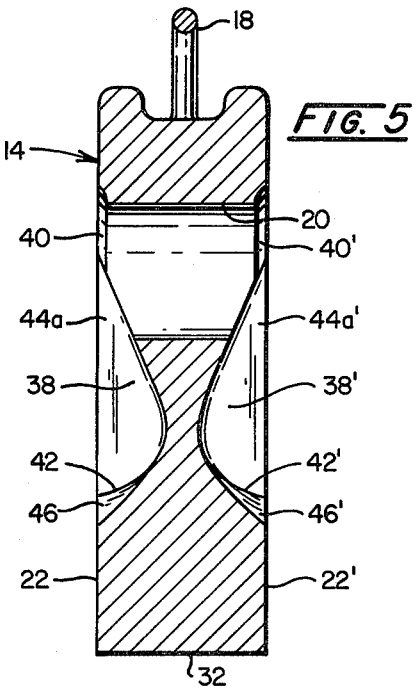
FIG. 5 is a view along line 5—5 of FIG. 3.

Referring to FIGS. 3–5, details of the construction of the improved hammer 14 of the instant invention will now be set forth. Hammer 14 is a large, generally bell-shaped casting which weighs several hundred pounds. An eye 18 is formed on the top of hammer 14 to facilitate handling of the large casting.

A lateral bore 20 is formed in the upper portion of hammer 14. The bore 20 receives the hinge pin 16 which pivotally mounts the hammer 14 between a pair of rotors 10, as described above. The sidewalls 22, 22' of the hammer perpendicular to the axis of bore 20 are generally flat and parallel to each other. When a hammer 14 is mounted on a hinge pin 16 each sidewall 22, 22' is adjacent a rotor 10.

The sidewalls 24, 24' of hammer 14, which are parallel to the axis of bore 20, have rounded upper portions 26, 26' and lower portions 28, 28' which are flared outwardly such that the bottom of the hammer 14 is substantially wider than the top. The bottom surface 30 of hammer 14 slopes downwardly from the bottom edge of each lower portion 28, 28' and terminates at an apex 32 on the hammer center line. A plurality of cutting edges 34, 34' are formed on the bottom surface 30 of hammer 14. Cutting edges 36, 36' are also formed in the lower side portions 28, 28' above those on bottom surface 30.

Referring to FIGS. 1, 3 and 5, it can be seen that each sidewall 22, 22' of hammer 14 has a recess 38, 38' which is generally bell-shaped. The recess 38, 38' provides a place to collect small pieces of scrap which get between the hammer 14 and a rotor 10 and prevent free swinging of the hammer 14 about its hinge pin 16. The recess 38, 38' is defined by a top surface 40, 40' which is approximately concentric with the center of bore 20, a bottom surface 42, 42' and sides **44*a*, 44*b*, 44*a'*, which connect the two. In FIG. 5, it can be seen that the width and depth of the recess 38, 38' increase from the top surface 40, 40' to the bottom surface 42, 42'**.

Each part **42*a*, 42*b*, of the bottom surface 42, 42' of the recess 38, 38' slopes downwardly and opens into a relatively narrow, centrally located spill port 46, 46'. Consequently, the deepest part of the recess 38, 38' is connected to the spill port 46, 46'. The spill port 46, 46' tapers outwardly and downwardly from the bottom surface 42, 42'. Referring to FIG. 1, it can be seen that the bottom surface 42, 42' is just inside the outer periphery of the rotors 10 and the spill port 46, 46' projects beyond the outer periphery of the rotors 10. As the rotors 10 are driven centrifugal force causes the scrap in the recess 38, 38' to be ejected through the spill port 46, 46'**. In this way, the recess is self-cleaning and does not get clogged with scrap.

Although a preferred embodiment of the invention has been illustrated and described, it will be apparent to those skilled in the art that various modifications may be made without departing from the spirit and scope of the present invention.

What is claimed is:

1. A hammer adapted to be pivotally attached to rotors in a hammer mill, comprising a body, a lateral bore formed in the upper portion of the body which receives a device for pivotally attaching the hammer between an adjacent pair of rotors, a pair of sidewalls on the body which are perpendicular to the axis of the bore, said sidewalls defining the lateral width of the body and being generally flat and parallel to each other and each of said sidewalls being located adjacent a rotor when the hammer is attached to a pair of rotors, a recess formed in at least one of the sidewalls for receiving pieces of scrap which get between the one hammer sidewall and a rotor, the recess having a portion projecting beyond the outer periphery of the adjacent rotor so that pieces of scrap in the recess can be ejected therefrom and the lateral bore opens into the recess.

2. The hammer set forth in claim 1, wherein the top surface of the recess is approximately parallel to the center line of the lateral bore, the bottom surface is radially inward of the periphery of the adjacent rotor, and the projecting portion of the recess opens into the bottom surface.

3. The hammer set forth in claim 1, wherein the recess has a top surface and a bottom surface and the depth of the recess increases from the top surface to the bottom surface.

4. The hammer set forth in claim 1, wherein the recess has a top surface and a bottom surface and the width of the recess increases from the top surface to the bottom surface.

* * * * *